US006101743A

United States Patent [19]

Brown

[11] Patent Number: 6,101,743

[45] **Date of Patent: *Aug. 15, 2000**

[54] CONSTRUCTION FOR ULTRA-THIN ORTHOTIC

[76] Inventor: Dennis N. Brown, 6867 Holeman Ave., Blaine, Wash. 98230

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,780

[22] Filed: Mar. 11, 1998

[51] Int. Cl.[7] ..... A43B 13/14

[52] U.S. Cl. ..... 36/102; 36/24.5; 36/31; 36/44

[58] Field of Search ..... 36/102, 24.5, 31, 36/41, 180, 181

[56] References Cited

U.S. PATENT DOCUMENTS 1,602,903 10/1926 Hartwell .
1,618,283 2/1927 Hartwell .
1,642,878 9/1927 Hartwell .
1,669,901 5/1928 Hartwell .
4,942,679 7/1990 Brandon et al. .

FOREIGN PATENT DOCUMENTS 304145 1/1917 France .
1168711 12/1958 France .

*Primary Examiner*—Ted Kavanaugh
*Attorney, Agent, or Firm*—Todd N. Hathaway

[57] ABSTRACT

A thin orthotic insert having a rigid rearfoot plate and a flexible forefoot cushion which are joined together without requiring a separate top cover. A connection is formed by a slot at the forward edge of the plate which receives and holds the rearward edge of the cushion layer. The rearfoot plate may be formed as a laminated structure, with forward edges of the upper and lower laminate layers being separated to form the wall portions above and below the slot. To form the slot, a spacer is inserted between the edges of the layers and then withdrawn after molding/curing. Because the need for a top cushion is eliminated, very low thicknesses can be achieved, on the order of 1.5 mm. The device is particularly advantageous for use in women's high-heeled shoes, where interior volume is extremely limited.

25 Claims, 4 Drawing Sheets

CONSTRUCTION FOR ULTRA-THIN ORTHOTIC

BACKGROUND OF THE INVENTION a. Field of the Invention

The present invention relates generally to orthotic devices for use in shoes, and, more particularly, to a construction for forming an ultra-thin orthotic device which occupies a minimum amount of volume within the interior of a shoe.

b. Background Art

Orthotic devices are typically contoured, plate-like structures which fit in a shoe so as to correct/control the position and function of the foot. Since the most critical functions of the foot generally involve the heel and midfoot portions, a degree of rigidity is required in these areas in order for the device to carry out its biomechanical purposes. Hence, many devices of this type have a rigid, resiliently flexible plate or cap which extends from the heel of the foot through the midfoot, to the area generally beneath the metatarsal heads, sometimes referred to as the "ball" of the foot. Forward of this point, in the area extending beneath the toes, it is advantageous for the device to be more flexible and cushioning in nature.

Consequently, the rearfoot plate is often formed of a generally rigid material such as fiberglass, graphite fiber-resin composites, various types of plastics, or combinations of these or similar materials, for example, while the forefoot portion (often referred to as a forefoot "extension") is typically formed of a layer of soft, cushioning material such as dense foam rubber or the like. The rearfoot and forefoot pieces are ordinarily bonded to the bottom of a top cover which ties the two together.

While such prior devices can be extremely effective in terms of their function, they present several difficulties from the standpoint of efficient manufacture. Firstly, while the top cover usually does not serve a critical function in terms of controlling the motions of the foot, it is nevertheless required in order to join the two other components together and adds significantly to the material cost of the product.

Also, it is critical that a strong bond be formed between the top cover and the underlying pieces to ensure that these do not come apart during extended use, and this is quite difficult and expensive to achieve in practice. For example, only certain, specialized adhesives are able to form an effective bond between the top cover (which is typically formed of Naugahide™ or a layer of similar material) and the rubber/fiberglass of the lower layers, and such adhesives are both expensive and difficult to work with. Moreover, even when using proper adhesives, the surfaces of the components must be roughened in order to ensure a proper bond: In practice, this means that the mating surfaces of the pieces, particularly the top surface of the fiberglass/plastic plate, must be roughened with a grinder or sander before application of the adhesive, and this is a laborious and time-consuming process which adds greatly to the expense of the product. The layer of adhesive also adds to the overall thickness of the device.

The need to include a top cover also presents a problem from the standpoint that this often makes the device too thick for use in many types of shoes. This has been a longstanding problem, particularly in the area of women's high-heeled shoes (although it would be understood that the advantages of the present invention are not limited to that particular application). The interior volume of high-heeled shoes (and some other types of shoes) is extremely limited, and hence there is very little extra space available to accommodate the thickness of an orthotic device. This is in part due to stylistic considerations, which tend to dictate that such shoes be as small and light in appearance as possible, but there are important functional reasons as well: Since the foot is immobilized in a high-heeled shoe and does not function in a normal manner (i.e., it does not go through the normal phases of the gait cycle, from heel strike to toe-off, in the same manner as it would if the person was wearing an ordinary shoe or walking barefoot), it is critical that the keel counter at the rear of the shoe fit very tightly around the person's heel. This stabilizes the foot/shoe and also keeps the heel from pulling out of the shoe as the foot moves towards toe-off, however this also means that there is almost no additional depth available in the heel area to accommodate an orthotic device.

Because of the need to include a top cover with a reasonable degree of durability, it has heretofore been virtually impossible to produce a practical orthotic device having a thickness less than about 3–4 millimeters. This is simply too thick for such devices to be used in most types of high-heeled shoes, and a number of prior attempts have been made to get around this problem by eliminating material from the shoe liner or from the heel area of the device itself; none of these approaches has been entirely satisfactory, due in part to the additional work which is required and/or the decrease in strength this causes.

Yet another difficulty with the construction used in such prior devices is that the attachment of the forefoot cushion or extension in fixed relationship to the rigid rearfoot plate means that there can be no lengthwise adjustment of the components, so that separate sizes of device must be produced and stocked for each size of shoe/foot. Naturally, this adds considerably to the manufacturer's overhead for the product, as well as adding to the expense and difficulty for a practitioner or retailer to maintain a complete stock of the devices.

Accordingly, there exists the need for a form of construction for an orthotic insert which eliminates the need for a top cover or similar separate connecting layer to join the rigid rearfoot and flexible forefoot portions of the device. Furthermore, there exists a need for such a construction which produces an orthotic insert having minimal thickness and which requires a minimum of volume within the interior of the shoe. Still further, there exists a need or such an insert which can be assembled quickly and efficiently, without requiring special adhesives or labor-intensive preparation techniques. Still further there exists a need for such an insert which allows for lengthwise adjustment between the rearfoot plate and forefoot extension, so as to permit a single device to be adjusted to fit more than one size of foot/shoe.

SUMMARY OF THE INVENTION

The present invention has solved the problems cited above. Broadly, this is an orthotic insert comprising: a rigid, resiliently flexible rearfoot plate member, a soft, resiliently compressible forefoot cushion member, and a joint portion connecting the forefoot cushion member to the rearfoot plate member, the joint portion comprising: first and second wall portions of the plate member which define a receiving slot along a forward edge thereof, and a border portion along a rearward edge of the forefoot cushion member which extends into the receiving slot so as to be held therein between the wall portions of the plate member.

The rearfoot plate member may be a laminated member, and the upper and lower wall portions may each comprise at least one layer of the laminated member. The laminated member may comprise a plurality of fiber-resin layers bonded to one another. In other embodiments, the plate member may be a solid, substantially homogeneous member.

The wall portion of the plate member may be inwardly biased so as to press against and grip said cushion member which extends into said receiving slot between said wall portions. The joint portion may be positioned so as to be located generally beneath the ball of a foot when the device is installed in a shoe, so that downward pressure exerted by the metatarsal head area on the joint presses the wall portions together against the border of the cushion member, so as to increase the grip between the forefoot cushion and rearfoot plate.

The insert may be configured to be installed in a high-heeled shoe, and in these embodiments, the rearfoot plate member may comprise a steeply-downcurved arch portion which extends from the joint portion to a heel portion of the plate, and the joint portion may be positioned so as to be located beneath a proximal side of the metatarsal head area of the foot, so that pressure exerted by the ball of the foot presses the joint downwardly and rearwardly against an insole of the shoe proximate the base of the arch portion thereof.

In a preferred embodiment, the laminated member may comprise at least four fiber-resin layers bonded to one another, the upper wall portion along the slot comprising a forward edge portion of at least two upper fiber-resin layers bonded to one another, and the lower wall portion comprising a forward edge portion of at least two lower fiber-resin layers bonded to one another. The rearfoot plate may have a maximum thickness of approximately 1–1.5 mm or less, and the receiving slot may have a depth in a range from about 0.75 cm to about 1.5 cm, preferably about 1.4 cm.

In those embodiments where the rearfoot plate member is a solid, substantially homogenous member, the receiving area may be a slot or groove cut into a forward edge portion of said plate member. The solid, homogenous member may be a rigid, resiliently flexible thermoplastic member.

The insert may be free from having any top cover member or other separate connecting member which extends over the rearfoot plate and forefoot cushion members.

The insert may further comprise an adhesive layer connecting the border portion of the forefoot cushioning member to the receiving slot of the rearfoot plate member.

The present invention also provides a method for forming an orthotic insert, comprising the steps of: providing a rigid, resiliently flexible rearfoot plate member; providing a soft, resiliently compressible forefoot cushion member; forming first and second wall portions of the rearfoot plate member which define a receiving slot along a forward edge thereof; and placing a border portion along a rearward edge of the forefoot cushion member in the receiving slot so that the border portion is held therein by the wall portions of the plate member. The step of forming first and second wall portions of said rearfoot plate member may comprise the step of forming the plate member with the wall portions being inwardly biased so as to press against and grip the border portion of the cushion member which is placed in the receiving slot between the wall portions.

The step of placing the border portion of the forefoot cushion member in the receiving slot may comprise the step of positioning a rearward edge of the cushion member at a depth within the receiving slot which is selected so as to provide the orthotic insert with an overall length which is selected to fit a predetermined size of shoe.

The step of placing the border portion of the forefoot cushion member in the receiving slot may also comprise the step of applying an adhesive in the receiving slot to join said cushion member to said rearfoot plate member.

The step of forming the rigid, resiliently flexible plate member may comprise the step of bonding a plurality of fiber-resin layers to one another, so as to form a laminated plate member. The step of forming the first and second wall portions which define the receiving slot may comprise the steps of: placing a plurality of uncured fiber-resin layers atop one another so as to form a layup stack having a configuration which corresponds to that of the plate member; placing a spacer piece in the laminate stack so as to separate at least one upper fiber-resin layer in the stack from at least one lower fiber-resin layer in the stack, in a portion of the stack which corresponds to the forward edge of the plate member; curing the fiber-resin layers so that the layers bond to one another so as to form the rigid rearfoot plate; and removing the spacer piece from the rearfoot plate so as to leave the receiving slot between the at least one upper fiber-resin layer which forms the upper wall portion and the at least one lower fiber-resin layer which forms the lower wall portion. The step of placing the spacer piece in the laminate stack may comprise the step of selecting the spacer piece to have a thickness which is substantially less than a predetermined thickness of the forefoot cushion member, so as to form a receiving slot which is substantially narrower than the thickness of the cushion member.

The step of placing the border portion of the cushion member in the receiving slot may comprise the step of spreading apart the wall portions which define the receiving slot, to a width which is substantially equal to or greater than the predetermined thickness of the forefoot cushion member; inserting the border portion of the cushion member into the receiving slot between the spread apart wall portions; and releasing the wall portions so that the wall portions are biased inwardly against the border portion of the cushion member which has been inserted in the slot.

The step of spreading the wall portions apart may comprise the step of drawing a line member into the receiving slot across the forward edge of the plate member, so as to force the wall portions apart from the rearward end of the slot; the line member may be a piece of heavy fishing line. The step of releasing the wall portions may comprise the step of withdrawing the line member laterally from the receiving slot so that the wall portions are released to collapse or spring inwardly against the portion of the cushion member in the slot.

The step of curing the fiber-resin layers so that the layers bond to one another to form the rigid rearfoot plate may comprise the steps of: placing the layup stack of uncured fiber-resin layers in contact with a mold having a contour which corresponds to that of a human foot; and heating the laminate stack in contact with the mold at a predetermined temperature and for a predetermined period of time, so that the fiber-resin layers deform to match the contour of the mold and bond to one another to form the rearfoot plate.

DETAILED DESCRIPTION a. Structure

Figure 1:
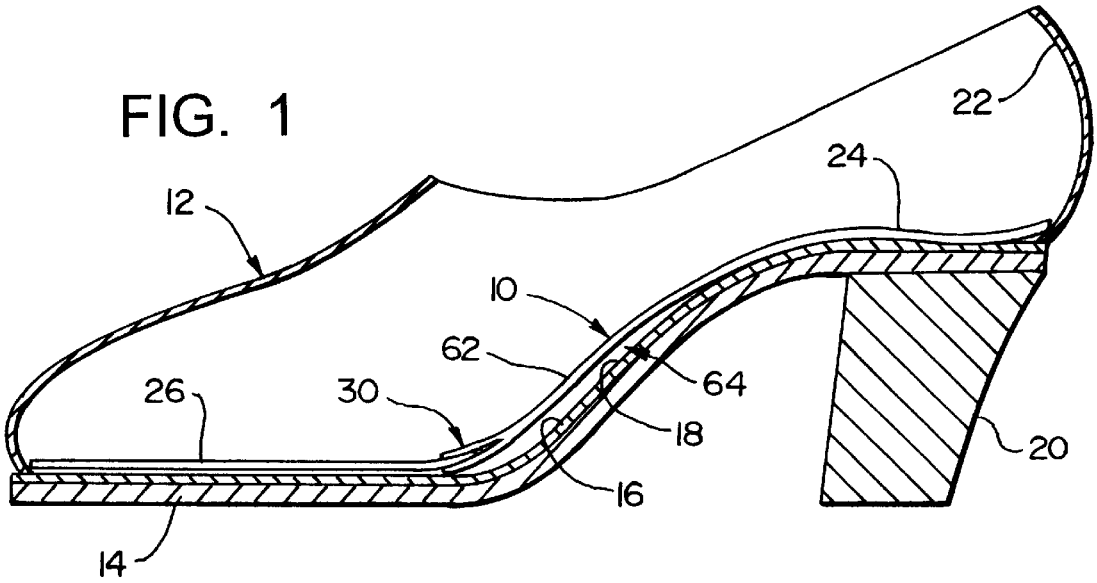
FIG. 1 is an elevational, side view of a cross-section taken longitudinally through a shoe having an orthotic insert therein which is constructed in accordance with the present invention, showing the positioning of the rigid rearfoot and flexible forefoot portions of the device.

FIG. 1 shows an orthotic insert 10 in accordance with the present invention, installed in an exemplary high-heeled shoe 12; as was noted above, certain of the advantages provided by the present invention are most pronounced with respect to women's high-heeled shoes, but it should be understood that the present invention is not limited to that specific application.

As is conventional, the shoe 12 includes an outsole 14 and insole 16, which define a steeply downcurved arch area 18. As is also conventional in such shoes, the heel area is supported by a comparatively high heel post 20, and there is a tight fitting heel counter 22 around the heel end of the shoe.

The orthotic insert 10 includes a rigid, resiliently flexible rearfoot plate 24 and a soft, resiliently compressible forefoot piece or extension 26, located in areas of the shoe generally similar to those occupied by corresponding components in conventional inserts. As can be seen in FIG. 1, however, no form of top cover is required in the construction of the present invention. Instead, the forward edge of the forefoot cushion is mounted joined to the forward edge of the rigid plate at a connection joint 30 which extends the full width of the device (see also FIG. 3).

Figure 2A:
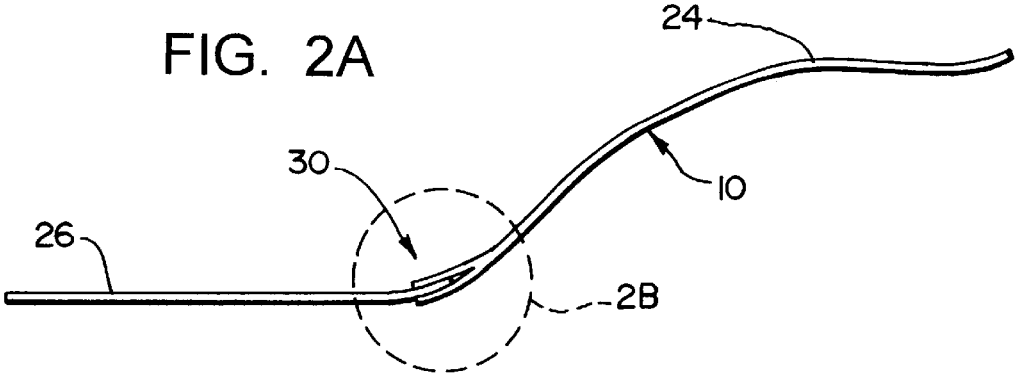
FIG. 2A is an elevational, side view of the orthotic device of FIG. 1, showing the joint which forms the connection between the rigid and flexible portions thereof.
Figure 2B:
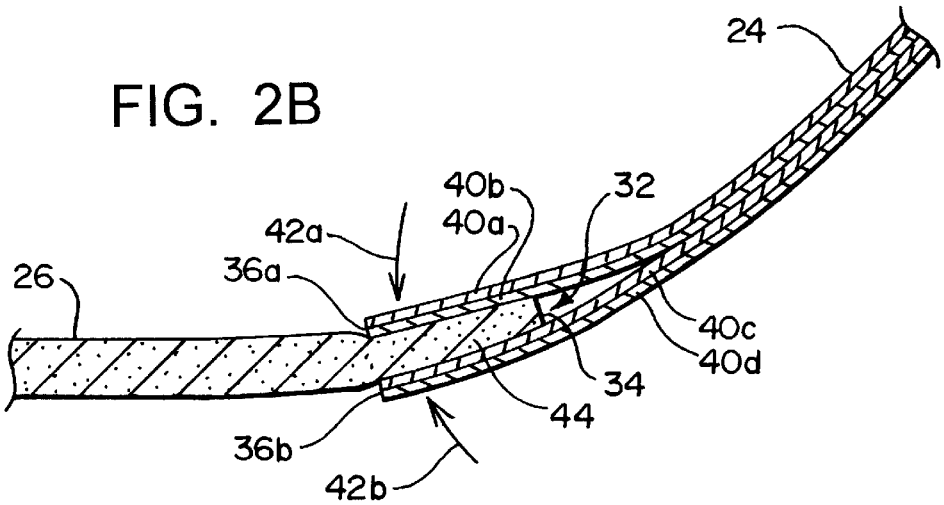
FIG. 2B is an enlarged view of the area indicated in FIG. 2A, showing the joint between the laminated fiberglass rearfoot portion of the device and the resilient, rubber-like forefoot portion in greater detail.

As can be seen more clearly in FIGS. 2A and 2B, the connection joint 30 comprises a narrow receiving slot 32 which is formed in the front edge of the rigid plate to receive and hold the rearward edge 34 of the forefoot cushion 26. As will be described in greater detail below, the upper and lower walls 36*a*, 36*b* which define the receiving slot 32 are formed by separation of one or more upper layers 40*a*, 40*b* of the laminate structure of the rigid plate 24, from one or more lower layers 40*c*, 40*d*. The separated layers flex inwardly towards one another, as indicated by arrows 42*a*, 42*b* in FIG. 2B, so that the material along the rearward border 44 of the forefoot cushion is gripped and compressed to some degree within the receiving slot. In a preferred embodiment, the layers are biased somewhat towards one another; also, the forwardly extending layer is preferably somewhat longer than the lower, as is shown in FIG. 2B, so that downward pressure against the upper layer causes flexion of its lip downwardly against the top of the lower layer so as to exert a "pinching" action on the border of the forefoot cushion.

The firm grip which is exerted on the rearward edge of the forefoot cushion eliminates any need for a separate top cover to join the two pieces. As a result, the present invention allows the construction of an extraordinarily thin device: In the embodiment which is illustrated, the average thickness through all areas is only about 1–1.5 millimeter, approximately half the thickness of the conventional types of devices described above. Moreover, by eliminating the use of a top cover, the expense and labor involved in gluing the three pieces together is dispensed with; a small amount of adhesive may be applied in the receiving slot, but in many applications this has been found to be unnecessary.

The result is a durable and economical orthotic which can function effectively without occupying a significant volume within the interior of a shoe, and which is therefore particularly advantageous for use in women's high-heeled shoes.

b. Assembly

FIGS. 4A–4D and 5A–5B show the steps in constructing an orthotic device in accordance with one embodiment of the present invention.

Figure 4A:
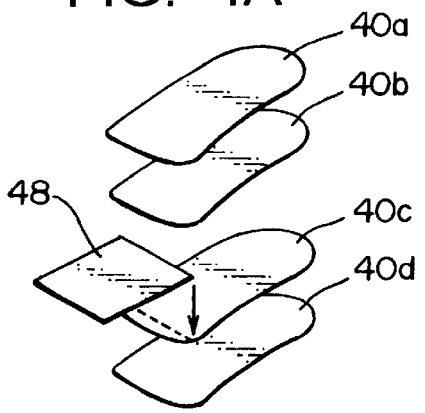
FIGS. 4A–4D are sequential, perspective views illustrating schematically the manner in which the rigid rearfoot portion of the device is constructed of a series of molded fiber-resin layers so as to have the slot portion of the joint in the forward edge thereof.

FIG. 4A shows four separate fiber-resin layers which are bonded together to form the rigid, resiliently flexible rearfoot/midfoot plate 24. The fiber-resin layers may be formed of fiberglass-resin material, a graphite fiber-resin material, and/or any of a variety of other, somewhat similar materials in which there is a resin-impregnated fiber matrix formed of such materials as Kevlar™, Spectra™, and the like. For example, fiberglass and graphite fiber-resin sheet materials which are eminently suitable for use in the embodiment of the invention illustrated herein include those available from Bryte Technologies, Inc. of 2025 O'Toole Avenue, San Jose, Calif. 95131 under product numbers "7781 Fg/G0075B" (fiberglass, highly toughened epoxy prepreg, 38" width, 235 degree F cure, pigmented black), and "GR 190gsm/GOO75B" (graphite, highly toughened epoxy unitape, 190gsm FAW, 24" width, 235 degree F cure, pigmented black).

In their initial, uncured state, the resin-impregnated fiber layers 40*a*–40*d* are soft and flexible, and readily deform when pressed against a mold. When layered together and heated under pressure, the resins bond adjacent layers to one another, and then cure to form the rigid but resiliently flexible structure of the plate. The use of these materials to form orthotic plates in general is known to those skilled in the art, and is described in Applicant's U.S. Pat. Nos. 4,610,101, 4,611,413, 4,612,713, 4,628,621, and 4,654,984, amongst others, which are hereby incorporated by reference herein.

FIG. 4A shows four of the resin-impregnated fiberglass layers 40*a*, 40*b*, 40*c*, 40*d* being brought together to form the uncured structure of the rearfoot plate, this being referred to herein as a "layup stack." The layers are die cut to the approximate size and shape of the finished article.

The actual number of layers utilized is a matter of design choice, depending on the needs of the device and the actual type of material being used, although for purposes of durability it is preferable to have at least two layers in each of the wall portions 36*a*, 36*b* above and below the edge slot. For example, a total of five layers may be employed to form the device in accordance with the present invention, with two of the layers extending below the slot and three extending above it; in this configuration, the lower wall portion is comparatively more flexible and the upper wall portion is provided with greater strength to resist cracking/deterioration in use, yet remains sufficiently flexible to develop the gripping action against the lower wall portion.

Figure 4B:
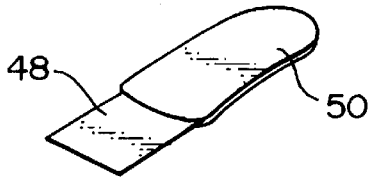

In order to form the edge slot in the laminated plate, a thin spacer piece 48 is inserted between the forward edges of the innermost two fiber-resin layers 40*b*, 40*c*, the distance of the overlap being selected to correspond to the depth of the receiving slot. Thus, when all the pieces have been placed on top of one another to form the layup stack 50 as shown in FIG. 4B, one edge of the spacer piece is sandwiched between the innermost layers of the stack, and the rest of the spacer extends out from between the layers in a forward direction.

The spacer piece prevents the resins of the innermost fiber-resin layers from bonding to one another along the receiving slot; the outer layers, however, bond to one another in the course of the molding process, resulting in the slot structure shown in FIG. 2B. The spacer piece is formed of a material which does not adhere to the resin component and which readily frees itself from engagement with the cured fiber-resin layers under tension, and the material should also be able to withstand the heat of the subsequent molding and curing steps without melting or deteriorating. Also, where it is desired to impart an inward bias to the wall portions in the final assembly, the thickness of the spacer piece (in the area where this extends between the fiber-resin layers) should be somewhat thinner than the layer of material which forms the cushioning forefoot piece 26.

A piece of folded flourinated ethylene propylene film (0.001", non-perforated), available from Airtech International of 2542 East Del Amo Boulevard, Carson, Calif. 90749-6207, is eminently suitable for use as the spacer piece 48, being that this material is very thin but still tough, slick, and heat resistant. It will be understood, however, that any number of other sheet materials, such as various plastics or metals, for example, could be used for this purpose, so long as the fiber-resin material does not "stick" to the spacer piece in the course of the molding/curing process.

Figure 4C:
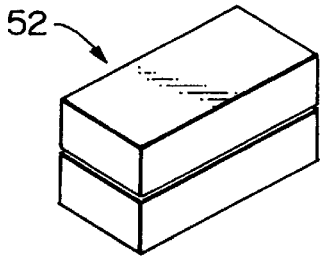
Figure 4D:
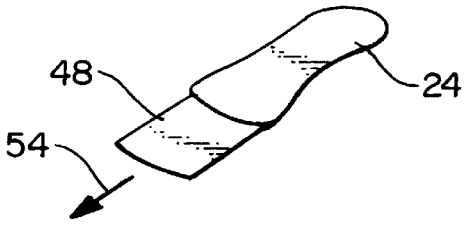

As is shown schematically in FIG. 4C, the layup stack 50 (with the spacer piece 48 in place) is next placed in contact with a mold 52. When using heat molded/cured materials such as those noted above, the mold will ordinarily be heated to a predetermined temperature and the layup stack will be maintained at an elevated temperature for some predetermined period of time. It will be understood, however, that the mold system may be of any type suitable for use with the materials which are employed, such as oven molding systems and vacuum and compression molds, to give just a few examples, and that moreover some laminate materials which may be employed in the present invention may not require heating as part of the molding/curing process. Also, in some embodiments the initial molding may be followed by subsequent and/or custom re-shaping of the plate.

The mold 52 shapes the contours of the plate to meet the requirements of the human foot, and (in the embodiment which is illustrated) the device is maintained at an elevated temperature until the fiber-resin material cures to form the rigid, resiliently flexible structure of the molded rearfoot plate. To provide the article with a smooth, finished appearance, and to eliminate the possibility of any fiber "hairs" being exposed at the surface, the layup stack may be sandwiched between upper and lower Tedlar™ sheets (not shown) prior to molding, so as which form a thin outer sheath over the assembly. A decorative pattern may also be formed on or placed in the mold so as form an embossed surface on the product.

After a predetermined cure time, the laminated plate 24 is removed from the mold and cooled. The spacer piece 48 is then removed by pulling this forwardly in the direction indicated by arrow 54 in FIG. 4D, thereby exposing the receiving slot 32. The edges of the plate 24 are then ground to final size and shape.

The forefoot cushion can be die cut to a predetermined size and shape, and may also be trimmed to individual requirements. Although a variety of thin cushioning materials may be used to form the forefoot piece, Vylyte™ sheet material, available from Stein's Foot Specialities of P.O. Box 327, Jessup, Ga., 31598-0327, is eminently suitable for this purpose owing to its superior combination of thinness, cushioning quality, and durability.

Figure 5A:
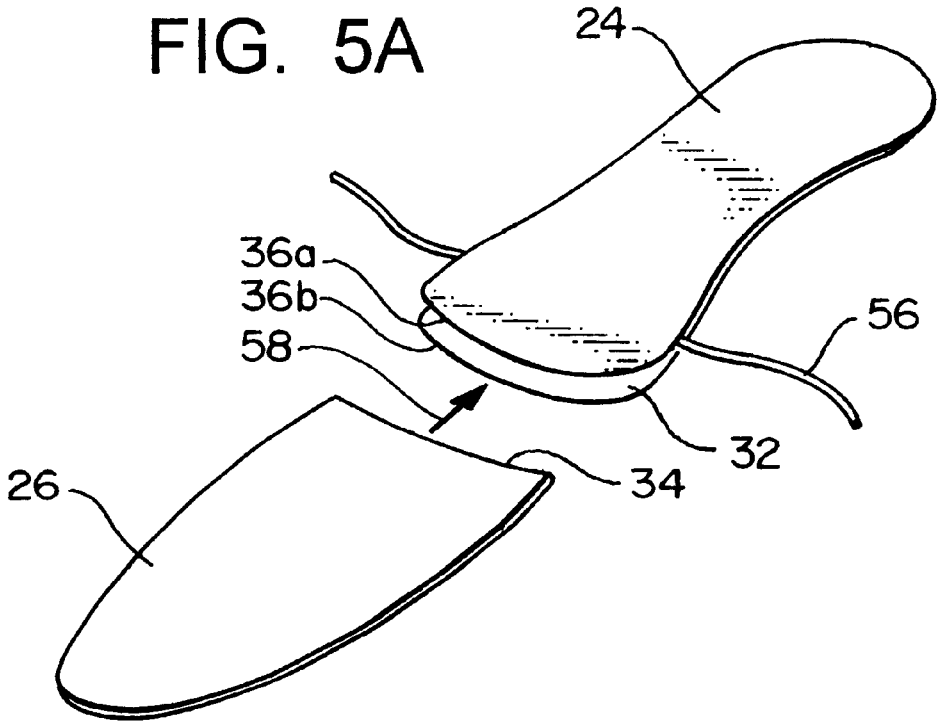
FIGS. 5A–5B are a sequential, perspective views showing the manner in which the rearward edge of the flexible forefoot portion is inserted in the slot at the forward edge of the rearfoot portion of the device.

As was noted above, the receiving slot may have a width which is less than the thickness of the forefoot cushion/extension, so that the wall portions are biased firmly against the latter. Accordingly, to attach the forefoot piece to the plate member, a piece of heavy fishing line 56 (or wire, string, or similar member) can be placed in the receiving slot 32 and pulled back to the rearward edge of the slot so as to spread the wall portions 36*a*, 36*b* apart, as shown in FIG. 5A. The line has a diameter slightly larger than the width of the slot, so that when this reaches the back of slot 32 the wall portions 36*a*, 36*b* are spread apart to form an enlarged gap which is wide enough to receive the rearward edge 34 of the cushion piece 26, this being inserted into the slot in the direction indicated by arrow 58 in FIG. 5A.

Figure 5B:
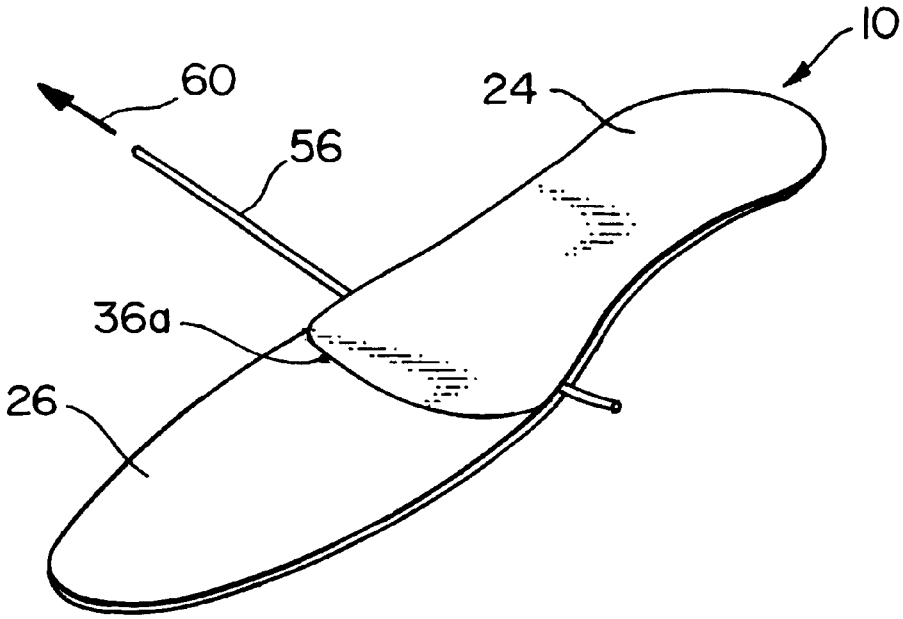

The line/string 56 is then withdrawn by pulling this out of the slot in a transverse direction, as indicated by arrow 60 in FIG. 5B. As this is done, the wall portions 36*a*, 36*b* on either side of the slot spring back together against the forefoot cushion along its rearward border, generating a clamping force which augments the grip developed by flexion of the upper wall portion against the lower during use. As was noted above, this connection may be supplemented by applying a small amount of adhesive to the material in slot 32, but in many instances this has been found to be unnecessary.

Although it is one of the principal advantages of the present invention that it eliminates the need for a top cover to connect the rearfoot and forefoot pieces, it will be understood that in some embodiments some form of top cover may still be included, for purposes of of comfort or aesthetics, for example. However, because the connection joint provided by the present invention relieves the cover of the need to carry the tension and other loads generated between the two members, the cover can be made much thinner and less bulky than in the case of the conventional types of devices described above.

Figure 3:
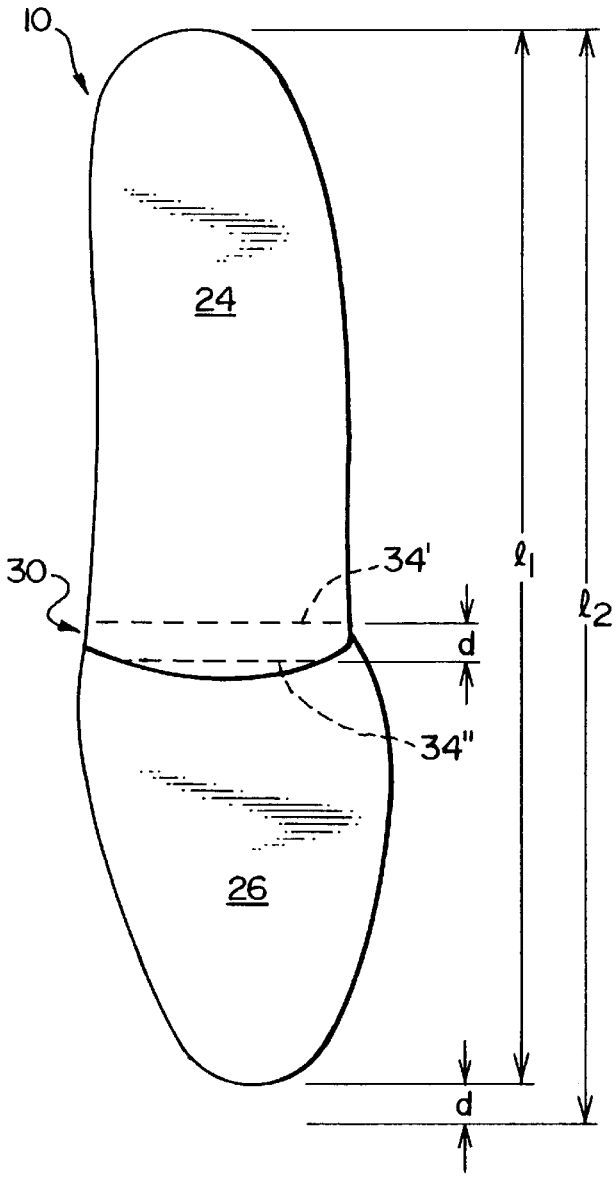
FIG. 3 is a plan view of the orthotic device of FIGS. 1–2B.

By selectively varying the position of the rearward edge 34 of the forefoot cushion in slot 32 during assembly (i.e., how far back this is positioned in the slot), the overall length of the insert can be adjusted within a predetermined range. As can be seen in FIG. 3, by moving the rearward edge of the forefoot cushion a selected distance "d", from a first position 34' near the back of the receiving slot to a second position 34" near the front, the overall length of the device can be increased by a corresponding amount, from a first length "$l_1$" to a second length "$l_2$". Thus, a single device can be adjusted to fit a variety of shoes over predetermined range of sizes, for example, size 9–10 shoes. This represents significant savings for the manufacturer (owing to the reduced number of parts and tools needed for the product line, smaller inventory, and so on), and also allows the purchaser or practitioner to more precisely tailor the fit of the device to an individual shoe.

For the purpose of providing a suitable range of adjustment, while still retaining the firm grip which is necessary to create a stable connection, the depth of the slot can suitably be within a range from about 0.75– 1.5 cm, with a range from about 1.0–1.4 cm being generally preferable when using 4–5 layers of fiberglass-resin material as described above. For example, a 1 cm deep slot provides a range of adjustment from a women's size 8 to a women's size 9 shoe. Markings or other surface indicia may also be provided to assist the user/assembler in making the proper size adjustments.

The joint construction described in the preceding paragraphs is particularly suited to embodiments in which the rearfoot plate of the insert is formed as a laminated structure and the forefoot cushion is formed from sheet material cut to shape. It will be understood, however, that other specific configurations which are within the spirit and scope of the present invention may be employed when working with other materials. For example, when working with a rearfoot plate cast or otherwise formed of polypropylene or other solid/homogeneous material, the receiving slot may be formed by cutting this in the forward edge of the plate, or by placing a spacer or corresponding piece in the mold in which the plate is formed. Also, in some embodiments the forefoot cushion may be formed as a molded piece (e.g., by injection molding), as with a shaped contour along its border which mates to form a flush surface with the forward edge of the rearfoot plate, for example. Still further the construction of the present invention allows one configuration of rearfoot plate to be used with a plurality of interchangeable forefoot cushion/extensions having a variety of characteristics, e.g., interchangeable extensions which are softer or firmer, thicker or thinner, formed of different types of materials, and so on.

c. Use

As can be seen in FIG. 1, in those embodiments where the device is configured to be installed in a high heel shoe, the arch portion 62 of the rearfoot plate has a curvature such that this extends somewhat above the arch portion of the insole, thus forming a spaced gap 64 between the two. The forward edge of the plate, in turn, "touches down" against the insole just forward of the arch portion of the shoe, so that the bifurcated connection 30 will be positioned under the ball of the foot, preferably proximal to the metatarsal heads and under the distal aspect of the metatarsal shafts.

Figure 6A:
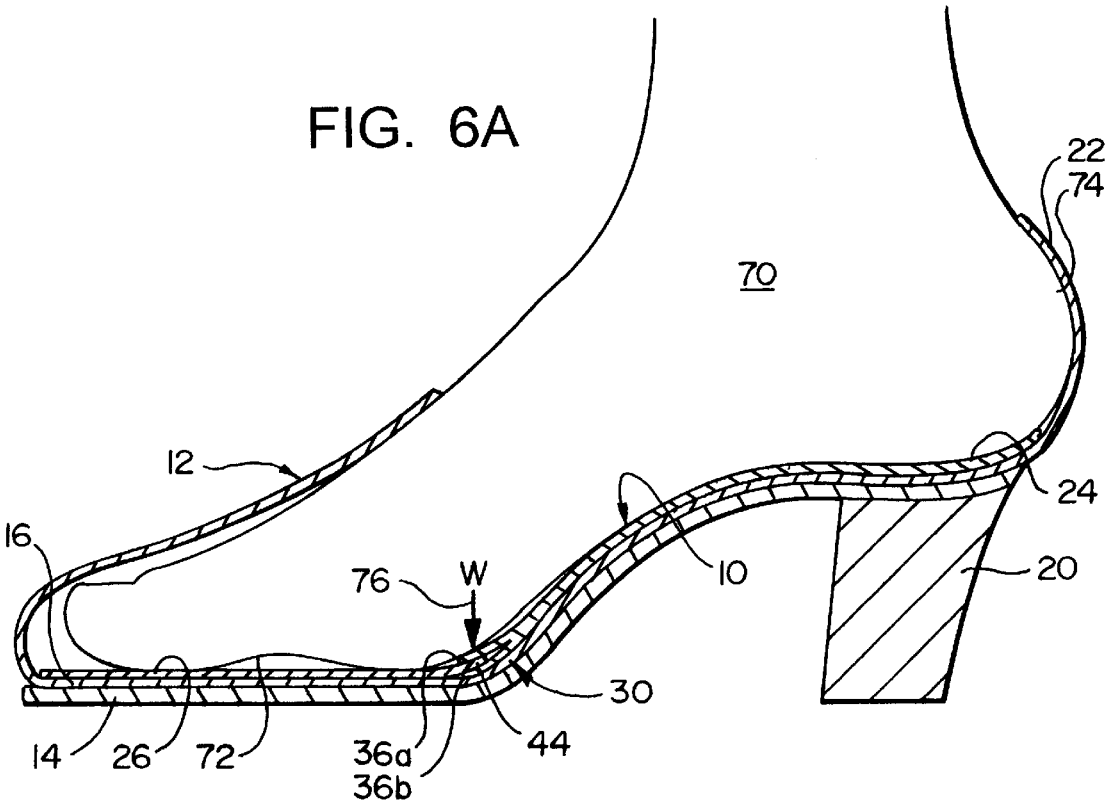
FIG. 6A is an elevational, side view of a longitudinal cross-section, similar to FIG. 1, showing the manner in which the joint which connects the forward and rearward portions of the insert is positioned generally proximal to the metatarsal heads of the person's foot, so that the weight on the ball of the foot presses the joint downwardly so as to clamp the pieces together in use.

Consequently, when the foot 70 is placed in the shoe as shown FIG. 6A, the toe area 72 forward of the metatarsal head area bears downwardly against the cushioning forefoot layer 26, while the heel fits tightly within the shoe's heel counter 22. Because the construction of the present invention eliminates the need for any top cover, the plate 24 can be extremely thin in the rearfoot area, thereby avoiding any interference with the establishment of the proper, contoured engagement between the heel counter and foot.

As the person's weight moves onto the midfoot area, the arch portion 62 of the device deforms resiliently so as to control the motion of the foot, until the spaced gap 64 disappears. The bulk of the weight is then transferred onto the ball of the foot, so that this bears a downwardly against the connection joint 30, as indicated by arrow 76 in FIG. 6A. This compresses the slotted joint, squeezing the rear border 44 of the forefoot layer between the upper and lower wall portions 36*a*, 36*b* of the rigid plate, and also pushes the upper wall 36*a* towards a steeper angle relative to the plane of the forefoot cushion, tending it to "pinch" the resiliently compressible material of the cushion between the leading edges of the two wall portions as the upper flexes downwardly against the lower. In combination, these forces tend to increase the clamping action against the forefoot cushion, so as to eliminate any possibly of the latter sliding forwardly out of the receiving slot. Also, the outer corners of the lower wall portion 36*b* tend to dig into surface of the insole 16 under the pressure, which in turn helps to eliminate any tendency of the rearfoot plate to slip or shift forwardly in the shoe.

Figure 6B:
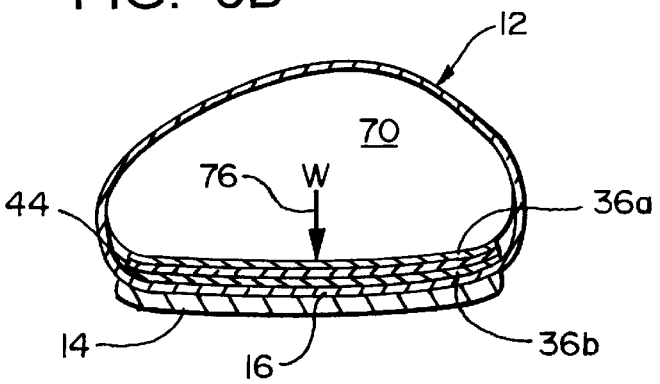
FIG. 6B is an elevational, front view of a transverse cross-section taken through the shoe and foot of FIG. 6A, showing the manner in which the construction of the joint enables this area of the device to flex downwardly under the ball of the foot so as to conform to the generally concave upper surface of the shoe's insole.

Moreover, as can be seen in FIG. 6B, the configuration of the connection joint 30 allows this to conform more readily to the contour of the insole 16 under the downward pressure of the ball of the foot, as indicated by arrow 76. This is because the reduced thicknesses of the wall portions 36*a*, 36*b* and the ability to bend independently of one another renders this area more softly flexible, so that frontal plane flexion causes this area to deform downwardly and "fill in" the underlying concavity in the top of the insole. This provides for smoother transition from the rigid midfoot plate to the forefoot cushion, and enhances wearer comfort. Also, the thinness of the upper wall portion 36*a* and the manner in which this presses or "beds" into the top of the soft, compressible layer of the forefoot cushion renders the joint virtually unnoticeable to the wearer's foot. Moreover, this action forces the medial and lateral edges at the front of the rigid rearfoot member to "dig in" or seat in the insole of the shoe, thereby enhancing stability of the assembly and reducing unwanted shifting or sliding of the device.

It is to be recognized that various alterations, modifications, and/or additions may be introduced into the constructions and arrangements of parts described above without departing from the spirit or ambit of the present invention as defined by the appended claims.

What is claimed is:

1. An orthotic insert for being placed inside an interior of a shoe so as to be positioned on top of a sole portion thereof, said orthotic insert comprising:

a rigid, resiliently flexible rearfoot plate member;

a soft, resiliently compressible forefoot cushion member; and a joint portion connecting said forefoot portion to said rearfoot plate member, said joint portion comprising:

first and second wall portions of said rearfoot plate member which define a receiving slot along a forward edge of said plate member; and a border portion along a rearward edge of said forefoot cushion member which is positioned in said receiving area so as to be held therein between said wall portions of said plate member;

said joint portion being configured so that an upper side thereof is engaged by a wearer's foot in said shoe and so that a lower side thereof is engaged by an upper surface of said sole portion of said shoe when said insert is placed therein, so that downward pressure exerted by said wearer's foot presses said wall portions together between said foot and said upper surface of said sole portion so as to increase a grip force between said plate and cushion portions of said insert.

2. The orthotic insert of claim 1, wherein said first and second wall portions are inwardly biased so that said border portion of said cushion member is compressed and gripped in said receiving slot by said wall portions.

3. The orthotic insert of claim 1, wherein said rearfoot plate member is a laminated member, and said first wall portion comprises a forward edge portion of at least one upper laminate layer of said laminated member, and said second wall portion comprises a forward edge portion of at least one lower laminate layer of said laminated member.

4. The orthotic insert of claim 3, wherein said laminated member comprises plurality of fiber-resin layers bonded to form said rearfoot plate member.

5. The orthotic insert of claim 4, wherein said laminated member comprises:

at least four said fiber-resin layers bonded to one another, said upper wall portion comprising a forward edge portion of at least two upper fiber-resin layers bonded to one another, and said lower wall portion comprising a forward edge portion of at least two lower fiber-resin layers bonded to one another.

6. The orthotic insert of claim 5, wherein said rearfoot plate portion has a maximum thickness of approximately 1.5 mm or less.

7. The orthotic insert of claim 6, wherein said receiving slot has a depth in the range from about 0.75 cm to about 1.5 cm.

8. The orthotic insert of claim 7, wherein said receiving slot has a depth of about 1.4 cm.

9. The orthotic insert of claim 1, wherein said rearfoot plate member is a substantially homogeneous member, and said first and second all portions comprise forward edge portions of said homogeneous member which are separated by said receiving slot along said forward edge of said plate member.

10. The orthotic insert of claim 9, wherein said receiving slot comprises a saw cut formed along said forward edge of said substantially homogeneous member.

11. The orthotic insert of claim 9, wherein said substantially homogeneous member comprises a rearfoot plate member formed of a thermoplastic material.

12. The orthotic insert claim 1, wherein said joint portion is positioned so as to be located generally beneath a ball of a foot when said insert is installed in a shoe, so that downward pressure exerted by said metatarsal head area on said joint portion presses said wall portions together against said border portion of said cushion member.

13. The orthotic insert of claim 12, wherein said insert is configured to be installed in a high-heeled shoe, and said rearfoot plate member comprises:

a steeply-downcurved arch portion which extends from said joint portion to a heel portion of said plate member.

14. The orthotic insert of claim 13, wherein said joint portion is positioned so as to be located generally proximal a metatarsal head area of a foot in said shoe, so that pressure exerted by said ball of said foot presses said joint portion downwardly and rearwardly against an insole of said shoe proximate a base of an arch portion of said shoe.

15. The orthotic insert of claim 14, wherein said arch portion of said rearfoot plate member has a downward curvature generally greater than a downward curvature of said arch portion of said shoe, so as to form a spaced gap between said arch portions of said plate member and said shoe when said plate member is in an unloaded configuration.

16. The orthotic insert of claim 1 wherein said first wall portion is positioned above said border portion of said cushion member and said second wall portion is positioned below said border portion, and wherein said second wall portion extends forwardly along said edge of said plate member a greater distance than said first wall portion, so that in response to downward pressure exerted by said foot, said first wall portion flexes downwardly against an upper side of said second wall portion so as to exert a pinching force against said border portion of said cushion member.

17. The orthotic insert of claim 1, wherein said insert is free from having any top cover member which extends over said rearfoot plate and forefoot cushion members.

18. The orthotic insert of claim 1, wherein said insert is free from having any separate connecting member which extends over said rearfoot plate and forefoot cushion members.

19. The orthotic insert of claim 1, further comprising:

an adhesive layer connecting said border portion of said forefoot cushioning member to said receiving slot of said rearfoot plate member.

20. An orthotic insert, comprising:

a rigid, resiliently flexible rearfoot member comprising at least four fiber-resin layers bonded to one another, said rearfoot plate member having a maximum thickness of about 1.5 mm or less;

a soft resiliently compressible forefoot cushion member; and a joint portion connecting said forefoot cushion member to said rearfoot plate member, said joint portion comprising:

first and second inwardly biased wall portions of said rearfoot plate member which define a receiving slot having a depth in the range from about 0.8 cm to about 1.5 cm, said first wall portion comprising a forward edge portion of at least two upper fiber-resin layers bonded to one another, and said lower wall portion comprising a forward edge portion of at least two lower fiber-resin layers bonded to one another; and a border portion along a rearward edge of said forefoot cushion member which is positioned in said receiving slot so as to be compressed and held therein by said inwardly-biased wall portions of said plate member;

said joint portion being positioned so as to be located generally beneath a ball of a foot when said insert is installed in a shoe, so that downward pressure exerted by said metatarsal head area on said joint portion presses said first and second wall portions together so as to increase a grip force between said forefoot cushion and rearfoot plate members;

said insert further being free from having any top cover member which extends over said rearfoot plate and forefoot cushion members.

21. An orthotic insert comprising:

a rigid, resiliently flexible rearfoot plate member;

a soft, resiliently compressible forefoot cushion member; and a joint portion connecting said forefoot cushion member to said rearfoot plate member, said joint portion comprising:

first and second wall portions of said rearfoot plate member which define a receiving slot along a forward edge of said plate member; and a border portion along a rearward edge of said forefoot cushion member which is positioned in said receiving area so as to be held therein between said wall portions of said plate member;

said joint portion being positioned so as to be located generally beneath a ball of a foot when said insert is installed in a shoe, so that downward pressure exerted by said metatarsal head area on said joint portion presses said wall portions together against said border portion so as to increase a grip force between said cushion and plate portions of said insert.

22. The orthotic insert of claim 21, wherein said lower wall portion extends forwardly along said edge of said plate member a greater distance than said upper wall portion, so that in response to downward pressure exerted by said ball of said foot, said upper wall portion flexes downwardly against an upper side of said lower wall portion so as to exert a pinching force against said border portion of said cushion member.

23. The orthotic insert of claim 21, wherein said insert is configured to be installed in a high-heeled shoe, and said rearfoot plate member comprises:

a steeply-downcurved arch portion which extends from said joint portion to a heel portion of said plate member.

24. The orthotic insert of claim 23, wherein said joint portion is positioned so as to be located generally proximal a metatarsal head area of a foot in said shoe, so that pressure exerted by said ball of said foot presses said joint portion downwardly and rearwardly against an insole of said shoe proximate a base of an arch portion of said shoe.

25. The orthotic insert of claim 24, wherein said arch portion of said rearfoot plate member has a downward curvature generally greater than a downward curvature of said arch portion of said shoes so as to form a spaced gap between said arch portions of said plate member and said shoe when said plate member is in an unloaded configuration.

* * * * *